US006532785B1

(12) United States Patent
Gmurowski

(10) Patent No.: US 6,532,785 B1
(45) Date of Patent: Mar. 18, 2003

(54) METHOD AND APPARATUS FOR PREFILLING AND HYDROFORMING PARTS

(75) Inventor: Romuald Gmurowski, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/996,316

(22) Filed: Nov. 20, 2001

(51) Int. Cl.[7] ..... B21D 39/08; B23P 17/02
(52) U.S. Cl. ..... 72/61; 72/62; 72/58
(58) Field of Search ..... 72/58, 62, 60, 72/61; 29/421.1

(56) References Cited

U.S. PATENT DOCUMENTS 3,625,040 A * 12/1971 De Gain ..... 72/62
5,233,856 A * 8/1993 Shimanovski et al. ..... 72/62
5,303,570 A * 4/1994 Kaiser ..... 29/421.1
5,445,002 A * 8/1995 Cudini et al. ..... 72/58
5,511,404 A * 4/1996 Klages et al. ..... 72/62
5,644,829 A * 7/1997 Mason et al. ..... 29/421.1

* cited by examiner

*Primary Examiner*—David Jones
(74) *Attorney, Agent, or Firm*—Charles E. Leahy

(57) ABSTRACT

Method and apparatus are disclosed wherein seal units sealingly connect a hydroforming fluid pressure source with the ends of a part to be hydroformed while the part is outside an intended die cavity and wherein the seal units are then conditioned with a relatively low sealing pressure capacity. The part is prefilled through the seal units with hydroforming fluid at a relatively low pressure sufficient to prevent later pinching, buckling, splitting and cracking of the part in the die cavity during hydroforming. The prefilled part, with the seal units remaining sealingly connected, is then enclosed in the die cavity and the seal units are conditioned with a relatively high pressure sealing capacity sufficient for the continued supply of hydroforming fluid to the part through the seal units at the considerably higher pressures required for hydroforming the part.

5 Claims, 5 Drawing Sheets

METHOD AND APPARATUS FOR PREFILLING AND HYDROFORMING PARTS

TECHNICAL FIELD

This invention relates to method and apparatus for preparing and hydroforming parts and more particularly to prefilling the parts and then hydroforming the prefilled parts.

BACKGROUND OF THE INVENTION

In the hydroforming of tubular metal parts, it is common practice as shown in FIGS. 1 and 2 of the accompanying drawings to employ a seal unit 10 located opposite each end of a tubular part 12 while the part is enclosed in a die cavity 14 formed by dies 16 and 18, only one such unit and one end of the part and dies being shown. The seal units include a piston 20 having a piston rod 21 to which a docking rod 22 is fixed. And the seal units are operated simultaneously to extend their docking rod to sealingly engage the respective end of the part with an interference fit when hydraulic fluid is supplied at pressure via a port 24 to a chamber 26 at one end of the piston while a chamber 28 at the other end of the piston is exhausted via a port 30.

This interference fit which is exaggerated in FIG. 2 for clarity is provided by a stepped cylindrical shoulder 32 near the end of the docking rod that has a relatively small diameter portion 32A that is closely received in the part and a larger diameter potion 32B of slightly larger diameter than the inner diameter of the part that is forced to enter the part to complete the sealed docking of the seal unit with the part. And the interference fit requires substantial axial force as well as adequate support about the outer diameter of the part where the docking rod enters. Moreover, the tubular part acts as a long slender column and must be prevented from buckling during this docking operation. Where buckling is a problem, conventional practice is to provide adequate confinement of the ends of the part in the hydroforming dies and to also preform the part to a certain compensating shape in special preforming dies prior to hydroforming the part in the hydroforming dies as further described below.

In the docking position, hydroforming fluid is supplied to fill the interior of the part through both seal units via a passage 34 in their docking rod. The pressure on this fluid is then gradually increased to expand the part outwardly while additional fluid is added with the part eventually being forced to conform to the die cavity surface wherein the part has been formed from the shape shown in phantom lines to the shape shown in solid lines in FIG. 1. As the part expands, the wall thickness tends to thin since a fixed amount of material in the part must now stretch to a larger dimension. To reduce or eliminate such wall thinning, the hydraulic pressure acting on the seal unit pistons is also gradually increased so that the piston force on the docking rods acting on the ends of the part exceeds the yield strength of the latter causing the part to shorten so that additional material from the part is supplied to the expanding portion of the part to minimize or eliminate such thinning.

Following the hydroforming of the part, the hydroforming fluid is drained from the part through the seal units and hydraulic fluid at pressure is then supplied to their chamber 28 while the other chamber 26 is exhausted to retract or withdraw their docking rod from the part. And the dies are then opened for removal of the hydroformed part.

While the above method and apparatus has proven generally satisfactory, a preforming operation as mentioned above is required in many cases to alter the cross-section of a round tubular part to for example a generally rectangular or square-shaped section in order to allow the part to freely enter the dies as they close about the part. If this preforming operation is not done in such cases, a part may be pinched at sections 12A and 12B between the mating surfaces 16A and 16B of the dies as shown in FIG. 3 as the dies close about the part. Furthermore, if such preforming is not done, it has been found that in many cases the part will have a tendency to buckle inwardly and will contact die cavity surface at multiple places when the dies are closed about the part as shown in FIG. 4. When this happens and the part is then filled with hydroforming fluid and this fluid is pressurized, the high pressure in the part causes high contact forces and thus high friction between the part and the die cavity surfaces at these places making it difficult, if not impossible, for the part to expand along the die cavity surface. Moreover, this adverse situation can cause a split or crack 36 as seen in FIG. 4.

SUMMARY OF THE INVENTION

The present invention solves such problems by prefilling the tubular part to be formed with hydroforming fluid at a relatively low pressure while still outside the die cavity. Moreover, this prefilling is accomplished with hydraulic piston operated seal units which are operable to establish a relatively low sealing capacity relationship with the end of the part for this prefilling and which remain with the prefilled part while the latter is enclosed in a die cavity. The seal units are further operable to then establish a high pressure sealing relationship with the part and provide for hydroforming fluid to then be supplied to the interior of the part through the seal units while the pressure of the fluid is gradually raised to form the part to the die cavity surface. And also while the part is compressed between its ends by the seal units to minimize or prevent thinning of the part. Thus there is eliminated any need for preforming a part to prevent pinching, buckling and splitting or cracking the part. And thus there is no need for preforming equipment and the personnel to operate such resulting in considerable cost, space and time savings.

Furthermore, a simple internal seal is used in the seal units for the prefilling which does not require any significant axial force to be applied to the ends of the part as this seal must only withstand the prefill pressure which, as has been found, may only need to be in the range of 800–1200 psi. On the other hand, an interference fit type seal is effected by the seal units to withstand the high hydroforming pressures which can be 25,000 psi and higher.

It is therefore an object of the present invention to provide a new and improved method and apparatus for preparing and hydroforming parts.

Another object is to provide method and apparatus wherein seal units are used to prefill a part to be hydroformed with hydroforming fluid at low pressure and then use these seal units while the part is in a die cavity for the supply to and pressurizing of the fluid in the part to form the part and also to compress the part between the seal units to minimize or prevent thinning of the part.

These and other objects, advantages and features of the present invention will become more apparent to those skilled in this art by the accompanying drawings and the following detailed description.

DESCRIPTION OF EXEMPLARY EMBODIMENTS

Figure 5:
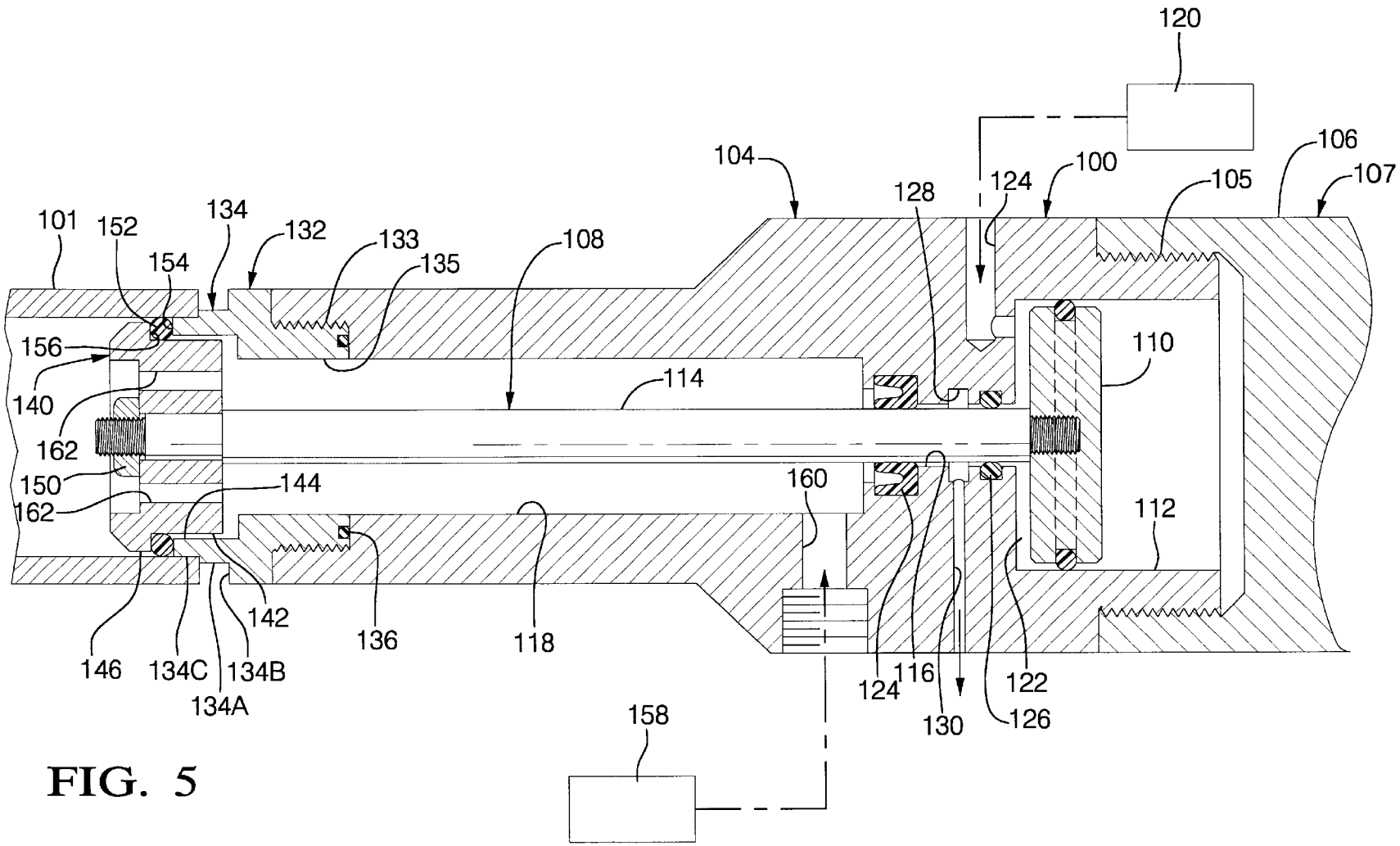
FIG. 5 is a partial side view partially in section of apparatus according to the present invention wherein a part is shown positioned for prefilling.
Figure 7:
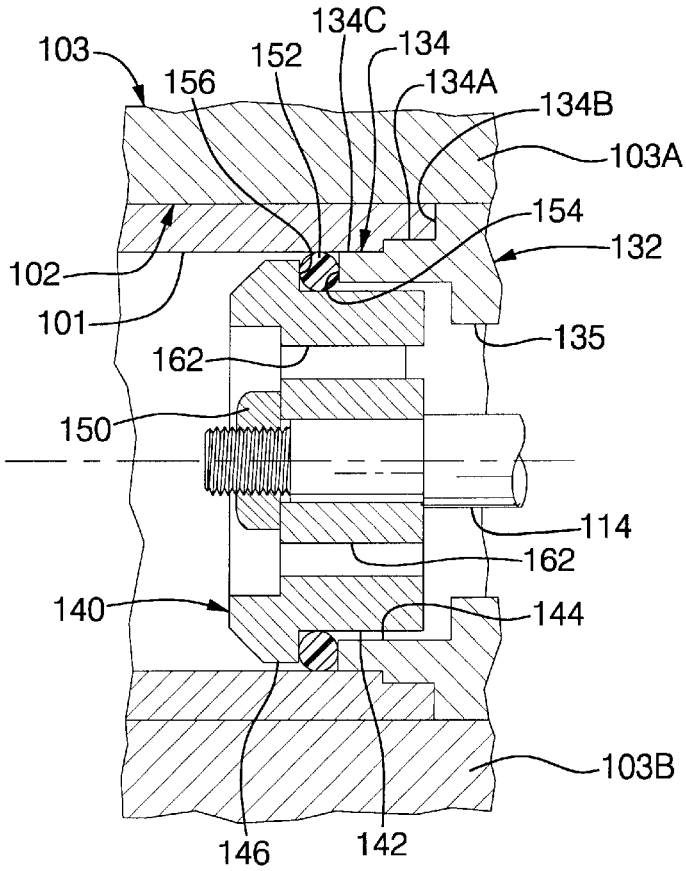
FIG. 7 is a view similar to FIG. 1 but showing the apparatus conditioned to hydroform the part.

FIGS. 1–4 have already been described above under BACKGROUND OF THE INVENTION. Referring now to FIG. 5, a seal unit 100 is shown as initially located at one end of a tubular part 101 to be formed. Prior to enclosing the part in a hydroforming die cavity 102 of a die set 103 comprising dies 103A and 103B as shown in FIG. 7. And it will be understood that a seal unit identical to seal unit 100 is located at the other end of the part and is operated simultaneously therewith and in the same manner as described below. It will also be understood that the seal units are mounted on a conventional elevator type assembly (not shown) for movement relative to the part and the die set forming the hydroforming die cavity.

Figure 1:
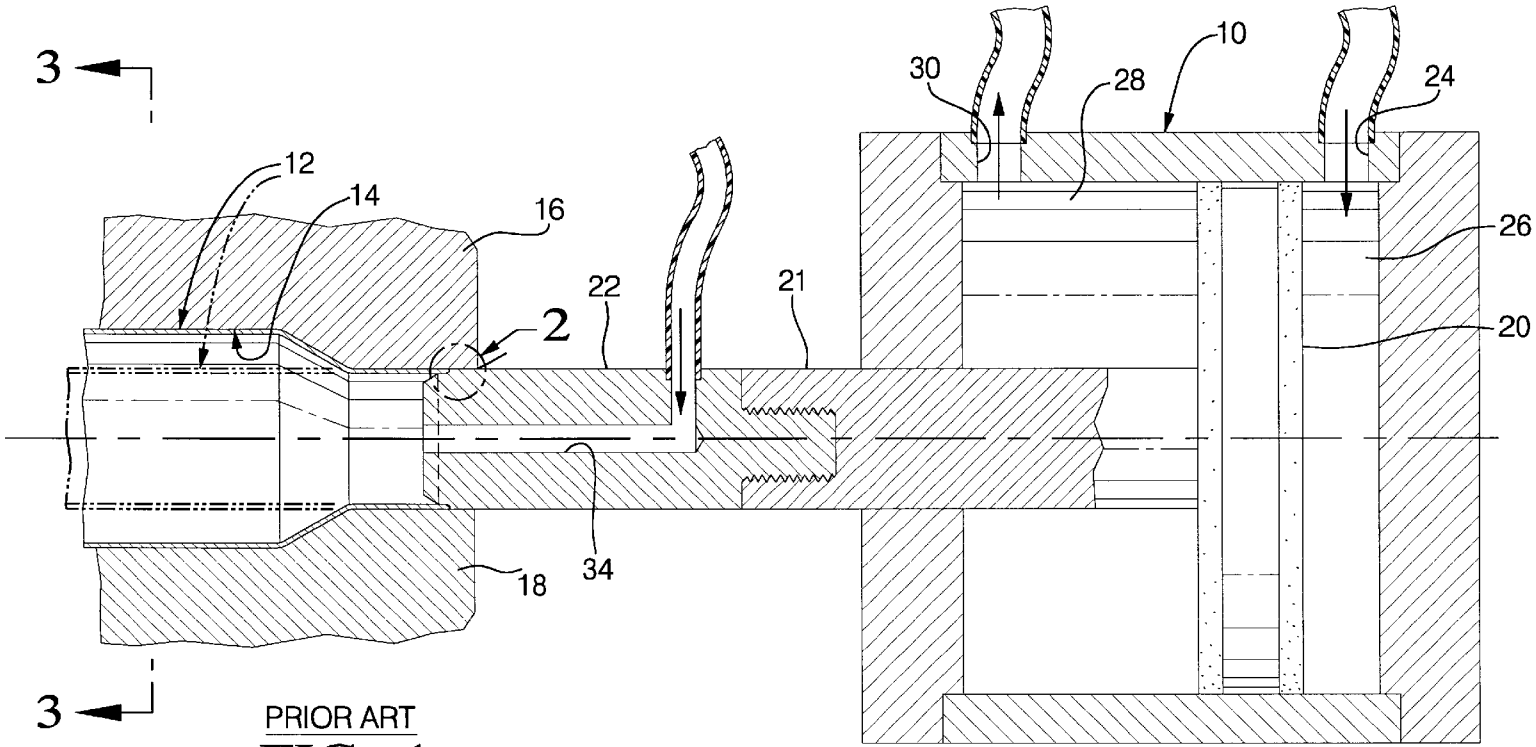
PRIOR ART FIG. 1
FIG. 1 is a partial side view partially in section of Prior Art hydroforming apparatus including a part being hydroformed.

The seal unit 100 comprises a housing 104 that is fastened at an outer end by a threaded connection 106 to the end of a piston rod 106 of a hydraulic cylinder 107 of a suitable conventional type like that in FIG. 1. And contained in the housing 104 is a hydraulic piston operated drawbar type of assembly 108.

The drawbar assembly 108 comprises a piston 110 that is received in a cylinder 112 in the outer end of the seal unit housing 104. The outer end of cylinder 112 is closed by the end of the piston rod 106 and the piston 110 has a cylindrical drawbar 114 fixed to the center thereof that is closely received in a bore 116 in housing 104 and extends through a larger diameter cylindrical bore 118 in this housing to the inner end of the seal unit. The piston 110 is operated by the selective supply of hydraulic fluid such as oil under pressure from a suitable conventional source 120 to a chamber 122 at the inner end of the piston via a passage 124 in the housing 104. With source 120 also providing for exhausting the chamber 122 to deactivate the piston 110. Sealing between the chamber 122 and bore 118 is provided by axially spaced elastomeric seals 124 and 126 which are received in annular grooves in the bore 116 and sealingly contact the drawbar 114 where the latter extends through this bore. And an annular drain cavity 128 is formed in the bore 116 between the seals 124 and 126 and is connected by a passage 130 also in the housing to drain any leakage past the seals from the seal unit.

Figure 2:
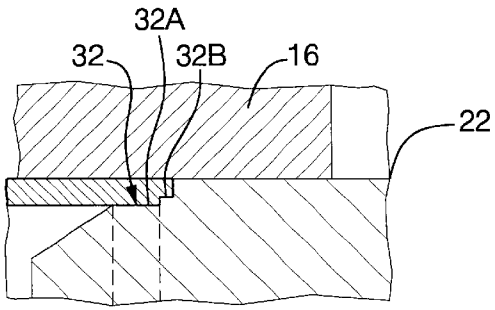
PRIOR ART FIG. 2
FIG. 2 is an enlarged view of the encircled section 2 in FIG. 1.
Figure 3:
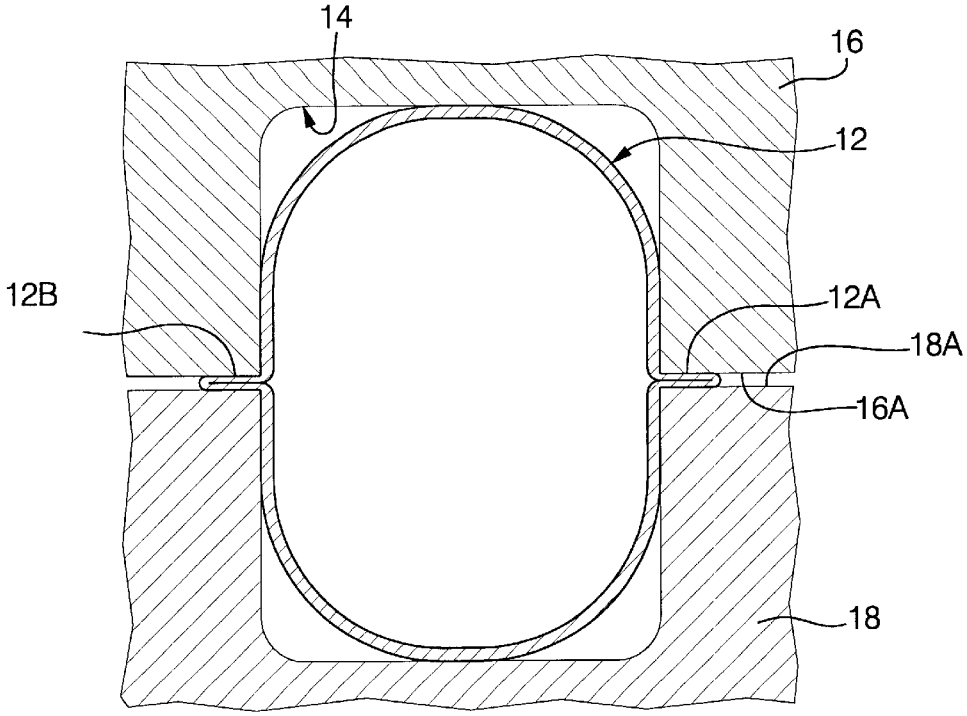
PRIOR ART FIG. 3
FIG. 3 is an enlarged cross-sectional view taken along the lines 3—3 in FIG. 1 when looking in the direction of the arrows and illustrates one potential problem in forming the part.
Figure 4:
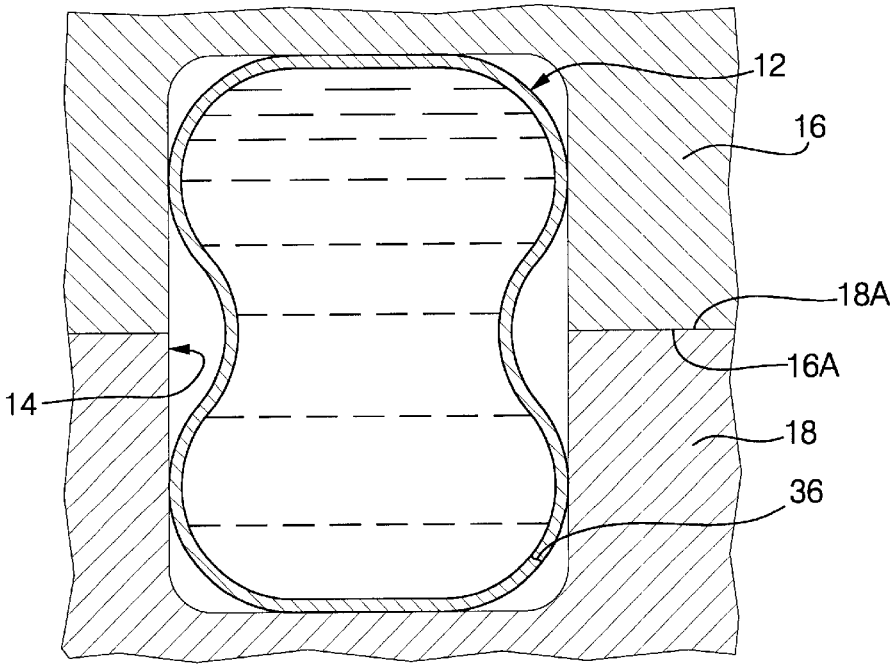
PRIOR ART FIG. 4
FIG. 4 is a view similar to FIG. 3 but illustrating another potential problem in forming the part.

A collar 132 is fastened by a threaded connection 133 to the inner end of the housing 104 and has an outer stepped cylindrical end portion 134 and a central bore 135 wherein the stepped end portion 134, like that in FIG. 2, includes an annular interference step portion 134A with a shoulder 134B and a smaller diameter end portion 134C that is closely slidably receivable in an end of the part 101. And wherein the central bore 135 forms an extension of housing bore 118 with their juncture sealed by an elastomeric seal 136. An end cap 140 is received in the outboard end of the collar 132 and has a cylindrical portion 142 that is slidably received in a counter-bore 144 in the collar 132 and another cylindrical portion 146 of larger diameter that is slidably receivable with clearance in an end of the part 101 ahead of collar end portion 134C. The outboard end of drawbar 114 extends through the center of the end cap 140 and is formed with a shoulder and threads so as to be firmly fastened to the drawbar with a nut 150. And an elastomeric O-ring seal 152 is located between an annular end edge 154 of the collar 132 and an annular radial shoulder 156 on the end cap 140 joining the small and large diameter portions 142 and 146 so as to be trapped between and receivable together with the end of end cap 140 and collar 132 in an end of the part 101.

Selective supply of hydroforming fluid such as a water based liquid and under pressure for forming the part is provided by a suitable conventional hydroforming fluid source 158 which is also operable to drain the part following forming. The seal unit 100 provides for communication between the hydroforming fluid source 158 and the interior of the part in both a prefilling operation outside the die cavity and for later hydroforming the part while in the die cavity. This communication is provided by a port 160 in the housing 104 connecting the hydroforming fluid source 158 to the inner end of the housing bore 118. And by the housing bore 118, collar bore 135 and parallel ports 162 in the end cap 140.

Figure 6:
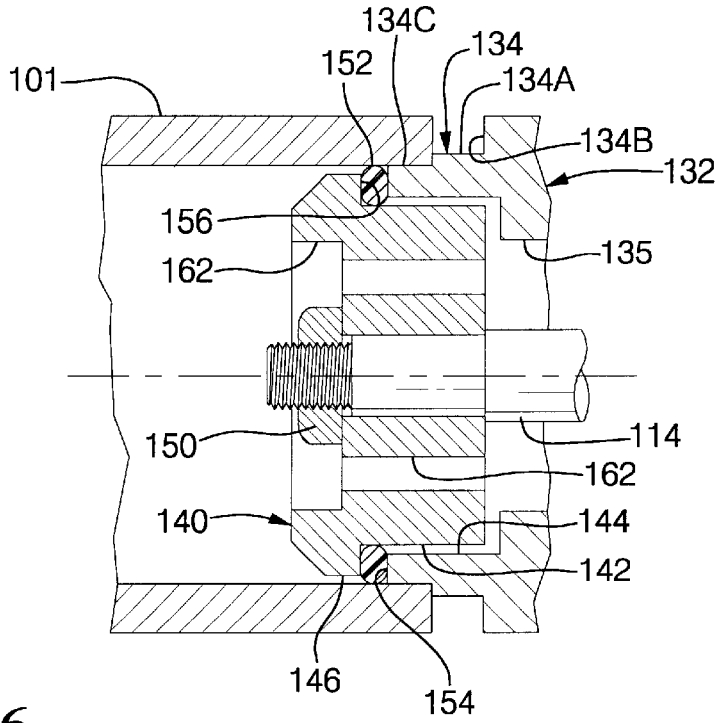
FIG. 6 is an enlarged view of a portion of FIG. 5 showing the apparatus conditioned to prefill the part.

Describing now the prefilling operation, the part 101 is initially positioned by a robot or other suitable conventional means outside of the dies and between and in axial alignment with seal unit 100 and an identical seal unit at the other end of the part by a robot or other suitable means. The seal unit's hydraulic cylinder 107 is then operated with oil pressure to extend the seal units toward the part until their end cap 140, O-ring 152 and collar 132 enter the respective end of the part and the interference step 134A on their collar engages the end of the part but does not force an interference fit at this juncture as shown in FIG. 5. Oil under pressure is then supplied to the chamber 122 in the seal units causing their piston 110 to pull their drawbar 114 and connected end cap 140 which then squeezes their trapped O-ring seal 152 causing the latter to expand outwardly against the inner diameter of the respective end of the part 101 as shown in FIG. 6 to effect sealing with a relatively low pressure sealing capacity between the seal units and the part. For example, a sealing capacity capable of withstanding up to about 1200 psi as compared with hydroforming pressures that can exceed 25,000 psi as it has been found that the former is sufficiently suitable for prefilling the part to prevent buckling, pinching and cracking or splitting of the part when the dies are closed on the part and the part is hydroformed.

With such initial sealing established for prefilling, hydroforming fluid under pressure is then supplied to the interior of the part 101 via the housing port 160, housing bore 118 and ports 162 in the seal units. And the part is thus prefilled with the hydroforming fluid and at a pressure up to the sealing capacity of their O-ring seal 152 sufficient to prevent later buckling, pinching, splitting or cracking of the part as the dies close there about. But not at a prefill pressure that would stretch the part.

With part 101 thus prefilled with hydroforming fluid at the desired pressure, the assembly comprising the seal units 100 with their hydraulic cylinder 107 and the prefilled part 101 is then positioned for enclosure of the prefilled part in the die cavity 102 as shown in FIG. 7. The seal unit's hydraulic cylinder 107 is then operated to further advance their collar 132 forcibly into the respective end of the part such that the interference step 134A on the collar is forced to enter the part and the shoulder 134B on the collar is forced to abut with the end of the part thereby creating a high pressure metal-to-metal seal between the part and the seal units having a sealing capacity capable of withstanding the large hydroforming pressures necessary to form the part. With such sealing effected, the hydraulic pressure on the seal unit's piston 110 is released allowing their drawbar 114 and connected end cap 140 and thus their O-ring seal 152 to relax. And hydroforming fluid under pressure is then supplied at increasing pressure to the prefilled part to expand the part outward to conform to the die cavity and again via the seal unit's housing bore 118, collar bore 135 and end cap ports 162. Moreover, the seal unit's hydraulic cylinder 107 may be further operated as desired to further advance their collar 132 now with the latter fully engage with the end of the part so as to compress the part between the seal units and thereby add material in the part to the portions being stretched to prevent or minimize their thinning. Following the forming of the part, the hydroforming fluid is drained from the part through the seal units, the die cavity is opened and the part together with the seal units are removed from the dies. Thereafter, the seal units are then retracted by their hydraulic cylinder 107 to release the formed part.

Figure 8:
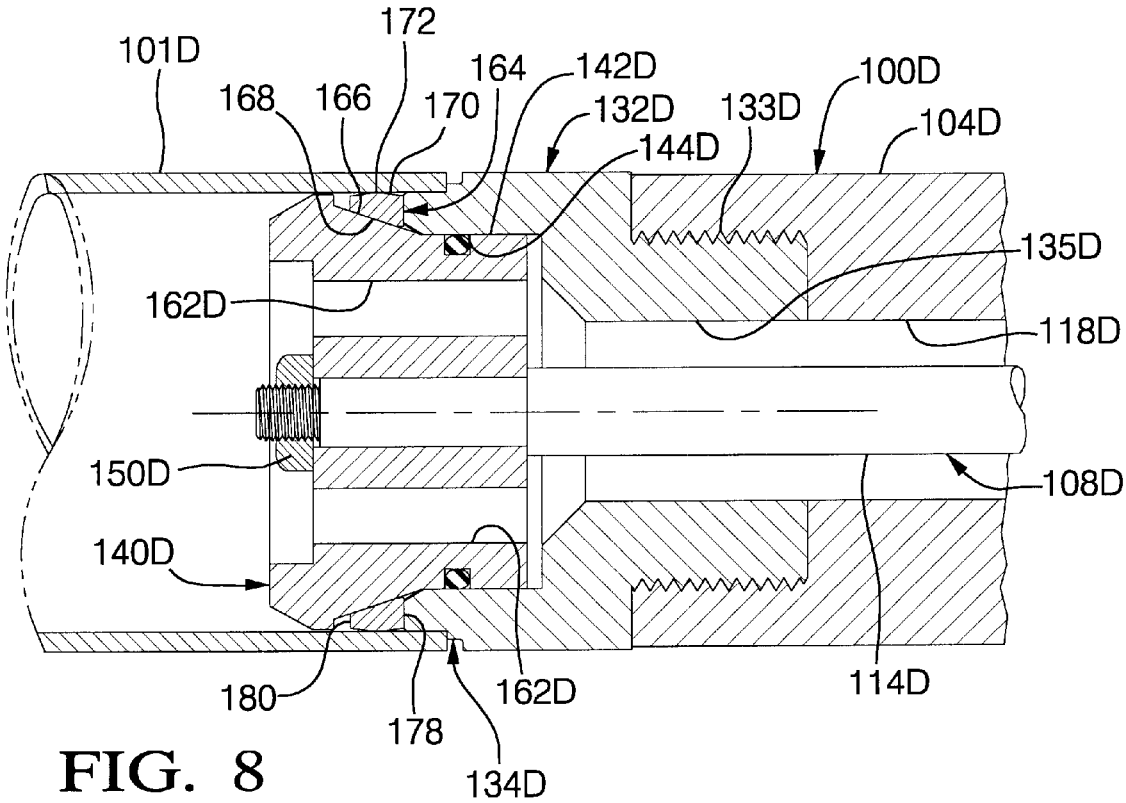
FIG. 8 is a partial side view partially in section similar to FIG. 5 but showing another embodiment of the prefill sealing means.
Figure 9:
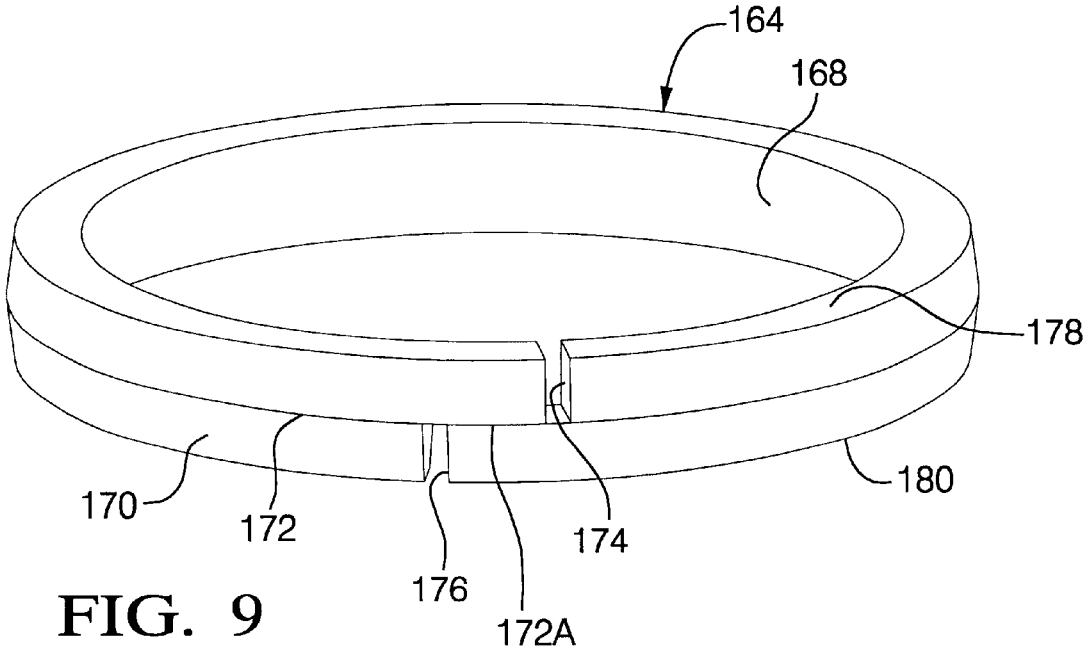
FIG. 9 is a three-dimensional view of the prefill seal in FIG. 8.

Various other forms of seals for sealing the prefilled part are contemplated including an elastomeric O-ring seal of square cross-section rather than the circular cross-sectional one 152 shown. And also a higher pressure capacity steel sealing ring 164 as shown in FIGS. 8 and 9 wherein parts corresponding to those previously described are referenced by the same numerals but with the suffix D. In this embodiment, the end cap 140D is provided with an additional tapered or conical portion 166. And a metal sealing ring 164 is received on the tapered end cap portion 166. The sealing ring 164 has an inner side 168 that is also tapered and an outer side 170 with a centrally located sharp circular cutting edge 172. The sealing ring 164 also has circumferentially spaced ring compliance gaps 174 and 176 in the respective annular end edges 178 and 180 of the ring that terminate at the cutting edge 172 leaving a sealing ring cutting edge overlap section 172A extending between the gaps 174 and 176.

When the end cap 140D is pulled by the drawbar 114D, the sharp cutting edge 172 is forced to bite into the inner surface of the part 101D to effect high pressure metal-to-metal sealing for the prefill operation. And with such metal-to-metal sealing being assured by the radial and annular compliance in the sealing ring 164 provided by the gaps 174 and 176 wherein the overlapping cutting edge section 172A is located at opposite sides with respect to these gaps. Elastomeric seal 181D prevents pre-fill fluid from escaping between diameters 141D and 142D and through the gap 174D. With such metal-to-metal sealing provided for the prefilling operation, prefill pressures considerably higher than 1200 psi can be used if found necessary to avoid buckling, pinching, cracking or splitting of the part.

The above disclosure of the method and apparatus of the present invention is intended to teach the invention to those skilled in this art. And those skilled in this art will with such disclosure likely arrive at various modifications. It will therefore be understood that the scope of the present invention is limited only by the scope of the appended claims.

What is claimed is:

1. A method of prefilling parts and hydroforming the prefilled parts comprising the steps of (a) sealingly connecting a seal unit with a low sealing pressure capacity to each end of a tubular part prior to enclosing the part in a die cavity, (b) supplying hydroforming fluid through the seal units to the interior of the part to fill the part, (c) pressurizing the fluid in the part through the seal units to a pressure below that which would expand the part, (d) enclosing the filled part in a die cavity, (e) increasing the sealing pressure capacity of the seal units to a high sealing pressure capacity sufficient to withstand a hydroforming pressure that would expand the part, and (e) continuing to supply hydroforming fluid through the seal units to the part while increasing the hydroforming fluid pressure to a pressure sufficient to expand the part to conform to the die cavity.

2. A method as defined in claim 1 wherein in step (a) the low pressure sealing capacity is effected by hydraulic action in the seal units separate from the hydroforming fluid.

3. A method as defined in claim 2 wherein in step (e) the high pressure sealing capacity is effected with metal-to-metal sealing by hydraulic action in the seal units separate from the hydroforming fluid.

4. A method as defined in claim 1 wherein in step (a) the low pressure sealing capacity is effected with elastomeric ring sealing by hydraulic action in the seal units separate from the hydroforming fluid.

5. A method as defined in claim 1 wherein in step (a) the low pressure sealing capacity is effected with metal-to-metal metal ring sealing by hydraulic action in the seal units separate from the hydroforming fluid.

* * * * *